US006327745B1

(12) United States Patent
Franke

(10) Patent No.: US 6,327,745 B1
(45) Date of Patent: Dec. 11, 2001

(54) MEANS FOR SUPPLYING FIBER MATERIAL TO A FIBER OPENING AND CLEANING APPARATUS

(75) Inventor: Christian Franke, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/651,728

(22) Filed: Aug. 30, 2000

(30) Foreign Application Priority Data

Aug. 30, 1999 (DE) ..... 199 41 446

(51) Int. Cl.[7] ..... D01B 1/00
(52) U.S. Cl. ..... 19/97.5; 19/200; 19/205
(58) Field of Search ..... 19/64.5, 65 A, 19/80 R, 85, 88, 89, 97.5, 105, 200, 204, 205

(56) References Cited

U.S. PATENT DOCUMENTS

Re. 31,802 * 1/1985 Einglett et al. ..... 19/64.5
4,262,390 * 4/1981 Einglett et al. ..... 19/64.5
4,300,267 * 11/1981 Winch et al. ..... 19/200
4,455,713 * 6/1984 Jones ..... 19/80 R
4,458,381 * 7/1984 Van Doorn et al. ..... 19/64.5
4,625,368 12/1986 Leifeld .
5,343,597 * 9/1994 Pinto et al. ..... 19/205
5,392,495 * 2/1995 Horn ..... 19/64.5
5,845,367 * 12/1998 Vezzoli et al. ..... 19/200

FOREIGN PATENT DOCUMENTS 39 32 282 4/1991 (DE) .
39 12 559 10/1992 (DE) .
2 108 543 5/1983 (GB) .
2 203 175 10/1988 (GB) .

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A fiber processing assembly includes a fiber processing machine having an inlet and an outlet; an arrangement for introducing fiber material into the fiber processing machine through the inlet; a fiber opening and cleaning machine having an inlet and an outlet and being disposed underneath the fiber processing machine; and an arrangement for advancing the fiber material from the fiber processing machine to the fiber opening and cleaning machine substantially solely by gravity.

6 Claims, 2 Drawing Sheets

MEANS FOR SUPPLYING FIBER MATERIAL TO A FIBER OPENING AND CLEANING APPARATUS

CROSS REFERENCE TO RELATED APPLICATION

This application claims the priority of German Application No. 199 41 446.7 filed Aug. 30, 1999, which is incorporated herein by reference.

BACKGROUND OF THE INVENTION

The invention relates to an apparatus for opening and cleaning fiber material. The apparatus may be of the type which has two horizontally spaced, parallel, codirectionally rotating first and second opening rolls (beater rolls) disposed in a housing above grid segments. Imaginary circles circumscribable about the two opening rolls almost touch one another. A vertical inlet pipe merges into the housing and is oriented tangentially to the first opening roll, as viewed in the direction of material advance. A horizontal outlet pipe extends from the housing at a side which is remote from the inlet pipe. The fiber material is introduced into the cleaner housing by the inlet pipe and is directed to the first opening roll. After treatment by the opening rolls, the fiber material leaves the housing through the horizontal outlet pipe.

Conventionally, the fiber material is pneumatically drawn from a fiber processing apparatus and pneumatically driven to the fiber opener/cleaner. The fiber material enters the inlet pipe together with the transporting air stream. It is a disadvantage of such an arrangement that the transporting air stream, which is relatively powerful because of the suction effect, adversely affects the opening and cleaning process. It is a further drawback that the pneumatic fiber material transport requires a relatively high technological outlay.

SUMMARY OF THE INVENTION

It is an object of the invention to provide an improved apparatus of the above-outlined type from which the discussed disadvantages are eliminated, which is structurally particularly simple and which makes possible an improved fiber opening and cleaning process.

This object and others to become apparent as the specification progresses, are accomplished by the invention, according to which, briefly stated, a fiber processing assembly includes a fiber processing machine having an inlet and an outlet; an arrangement for introducing fiber material into the fiber processing machine through the inlet; a fiber opening and cleaning machine having an inlet and an outlet and being disposed underneath the fiber processing machine; and an arrangement for advancing the fiber material from the fiber processing machine to the fiber opening and cleaning machine substantially solely by gravity.

By arranging the fiber processing device above the intake pipe, the fiber material proceeds by gravity downwardly into the intake pipe. The apparatus according to the invention is structurally significantly simplified by virtue of the absence of a pneumatic transporting air stream in the intake pipe. Further, the cleaning effect is improved by the fact that the fiber material is advanced within the opener/cleaner only by the opening rolls and may be assisted by an axially supplied air stream. In this manner a separation of functions between the admission of the fiber material to, and its guidance through, the opener/cleaner is effected.

DESCRIPTION OF THE PREFERRED EMBODIMENT

Figure 1:
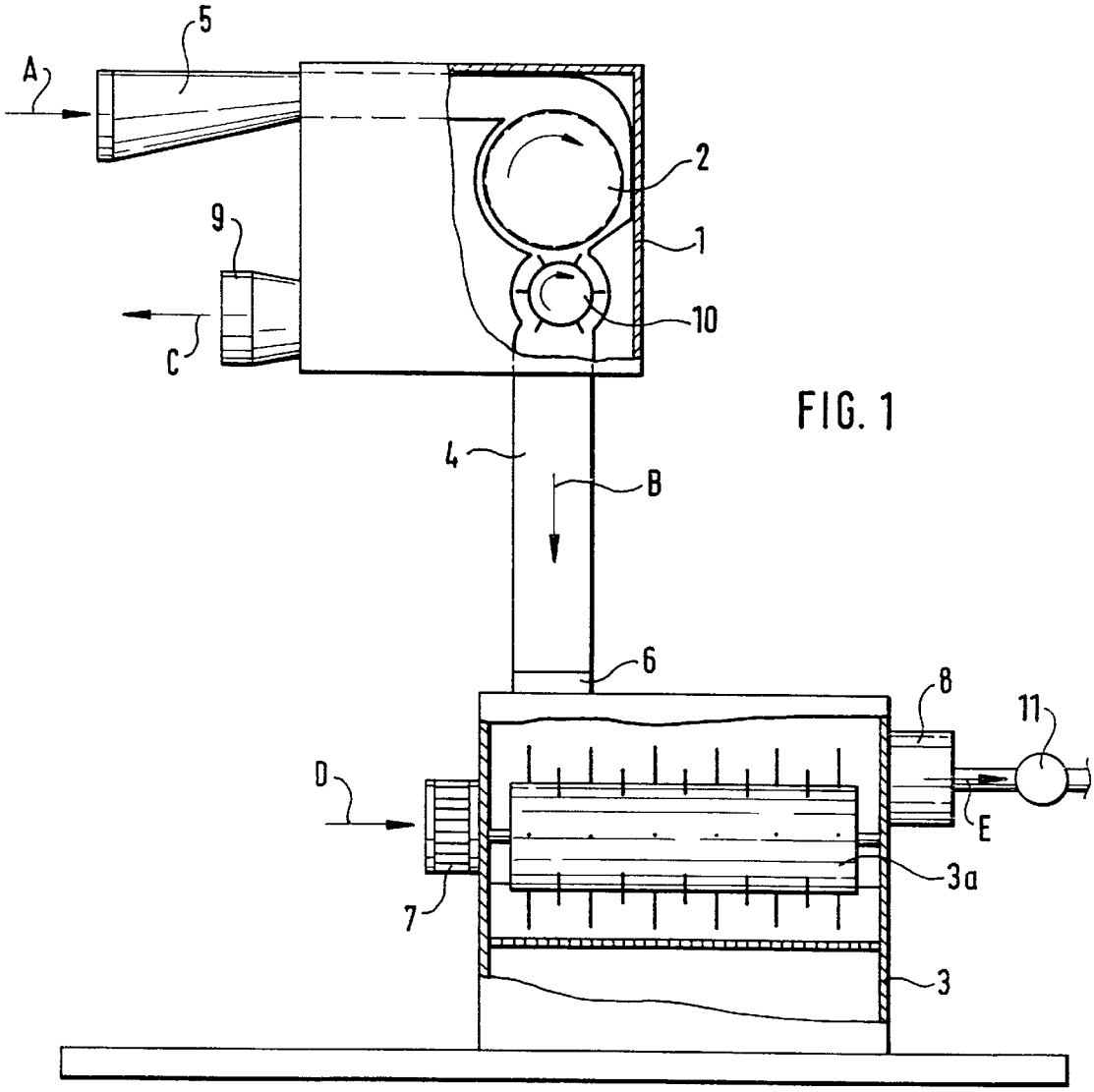
FIG. 1 is a schematic sectional side elevational view of a preferred embodiment of the invention.
Figure 2:
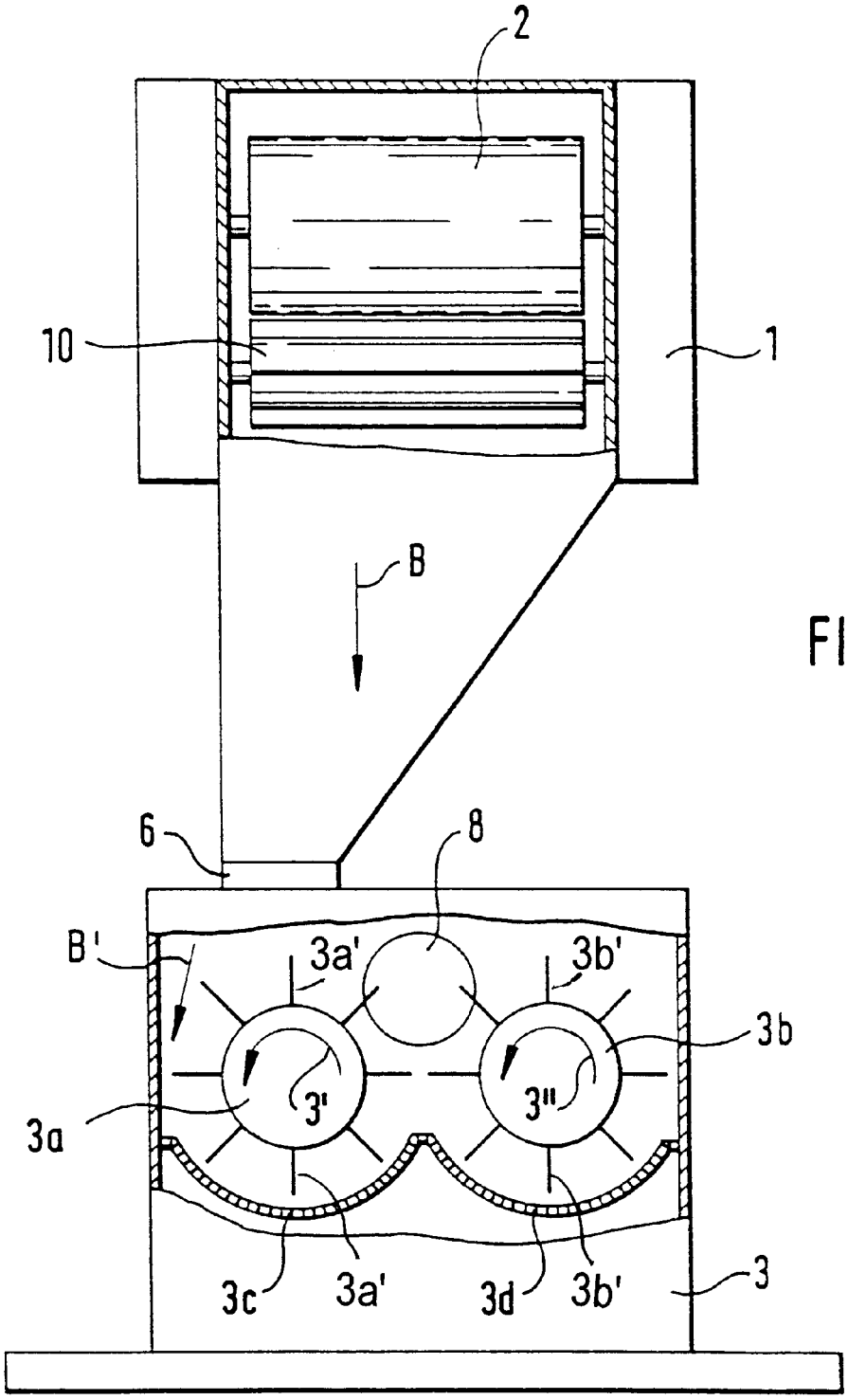
FIG. 2 is a schematic sectional front elevational view of the structure shown in FIG. 1.

FIGS. 1 and 2 show a fiber processing device which includes a condenser 1 having a sieve drum (dust cage) 2 and a finned roll 10 cooperating therewith. The fiber processing device may be a fiber out-transporting unit, such as an ascending lattice belt of a fiber opener.

Underneath the condenser 1 a horizontal opener/cleaner 3 is arranged which may be, for example, an AXI-FLO AFC model double-roll cleaner manufactured by Trützschler GmbH & Co. KG, Mönchengladbach, Germany. The condenser 1 and the cleaner 3 are connected to one another with a funnel-shaped hopper 4. The condenser 1 is situated above the pipe inlet 6 of the cleaner 3. The cleaner 3 has two rotary beater rolls 3*a* and 3*b* below which respective grids 3*c* and 3*d* are arranged. The beater rolls 3*a* and 3*d* have respective cleaning elements 3*a*' and 3*b*' on their outer surface. The beater rolls 3*a* and 3*b* rotate in directions indicated by respective arrows 3' and 3". In opposite housing walls of the cleaner 3 an axially oriented air inlet pipe 7 and an outlet pipe 8 are arranged through which an air stream flows through the housing parallel to the axes of the beater rolls 3*a* and 3*b*. The outlet pipe 8 is coupled to a vacuum source 11.

During operation a mixture A of air and fiber (which may be cotton and/or synthetic fiber) is pneumatically advanced from a non-illustrated spinning preparation machine through a conduit 5 to the condenser 1. By virtue of the rotary sieve drum 2 of the condenser 1 the transporting air stream C is separated from the fiber material and removed through the outlet pipe 9.

The fiber material designated by the arrow B falls by gravity from the condenser 1 through the hopper 4 into the intake pipe 6 and is then introduced into the inner space of the cleaner 3 as indicated at B'. A regulatable air stream D flows through the inlet pipe 7 into the cleaner 3 and axially entrains the fiber material treated by the beater rolls 3*a* and 3*b* and exits through the outlet pipe 8 as a fiber/air mixture E.

It will be understood that the above description of the present invention is susceptible to various modifications, changes and adaptations, and the same are intended to be comprehended within the meaning and range of equivalents of the appended claims.

What is claimed is:

1. A fiber processing assembly comprising (a) a fiber opening and cleaning machine including (1) a housing having a first end and an opposite second end, an air inlet provided in said housing adjacent said first end thereof for guiding an air stream along said opening rolls to entrain fiber material therefrom through a fiber material outlet;

(2) first and second horizontally side-by-side positioned opening rolls extending horizontally within said housing essentially from said first end to said second end; said opening rolls being provided with cleaning elements on outer surfaces thereof;

(3) a fiber material inlet provided in said housing at a top part thereof, adjacent said first end and in vertical alignment with said first opening roll; and (4) said fiber material outlet provided in said housing adjacent said second end thereof, whereby the fiber material is simultaneously treated as it passes along the first and second opening rolls from the first end of the housing to the second end thereof;

(b) a fiber processing machine disposed above said fiber opening and cleaning machine; and (c) means for advancing fiber material from said fiber processing machine to said first opening roll through said fiber material inlet substantially solely by gravity.

(d) an air inlet provided in said housing adjacent said first end thereof for guiding an air stream along said opening rolls to entrain fiber material therefrom through a fiber material outlet.

2. The fiber processing assembly as defined in claim 1, further comprising a hopper extending from an outlet of said fiber processing machine to the fiber material inlet of said fiber opening and cleaning machine for guiding the fiber material falling by gravity therein.

3. The fiber processing assembly as defined in claim 2, wherein said fiber processing machine comprises separating means for separating a conveying air stream from the fiber material before the fiber material passes into said hopper from said fiber processing machine.

4. The fiber processing assembly as defined in claim 3, wherein said fiber processing machine comprises a condenser having a rotary sieve drum; said rotary sieve drum forming part of said separating means.

5. The fiber processing assembly as defined in claim 1, wherein the air inlet is horizontally oriented.

6. The fiber processing assembly as defined in claim 5, further comprising a vacuum source coupled to said fiber material outlet of said fiber opening and cleaning machine.

* * * * *